US008419475B2

(12) United States Patent
von zur Muehlen

(10) Patent No.: US 8,419,475 B2
(45) Date of Patent: Apr. 16, 2013

(54) MODULAR OPEN FUSEHOLDER WITH MULTI-STAGE POSITIONABLE COVER

(75) Inventor: Patrick A. von zur Muehlen, Wildwood, MO (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/186,055

(22) Filed: Jul. 19, 2011

(65) Prior Publication Data

US 2013/0023156 A1 Jan. 24, 2013

(51) Int. Cl.
*H01R 13/66* (2006.01)

(52) U.S. Cl.
USPC ..... 439/620.26; 439/893

(58) Field of Classification Search ..... 439/620.26–620.34, 698, 830–833, 439/893; 337/187, 194, 195, 196, 205, 208, 337/227
See application file for complete search history.

(56) References Cited

U.S. PATENT DOCUMENTS 3,418,615 A * 12/1968 Canney ..... 337/190
3,976,967 A * 8/1976 Magherini ..... 337/211
5,076,118 A * 12/1991 Lawson ..... 81/3.8
5,171,293 A * 12/1992 Umemoto et al. ..... 439/620.33
5,435,755 A * 7/1995 Chien et al. ..... 439/620.29
5,515,023 A * 5/1996 Marach et al. ..... 337/213
5,590,019 A * 12/1996 Fox et al. ..... 361/643
5,616,054 A * 4/1997 Quinlan ..... 439/620.26
5,820,413 A * 10/1998 Yamada et al. ..... 439/620.26
5,969,587 A * 10/1999 Combas ..... 335/132
6,406,331 B1 * 6/2002 Brown ..... 439/620.33
6,650,222 B2 * 11/2003 Darr et al. ..... 337/187
6,727,797 B1 * 4/2004 Bruchmann ..... 337/210
6,775,148 B2 * 8/2004 Hong ..... 361/752
6,853,289 B2 * 2/2005 Scoggin ..... 337/194
7,355,503 B2 * 4/2008 Buettner ..... 337/211
7,705,706 B2 * 4/2010 Ding ..... 337/261
7,982,578 B2 * 7/2011 Buettner ..... 337/196
8,242,874 B2 * 8/2012 Pavlovic et al. ..... 337/187
2002/0067240 A1 * 6/2002 Darr et al. ..... 337/187
2003/0020589 A1 * 1/2003 Scoggin ..... 337/186
2009/0243786 A1 * 10/2009 Buettner ..... 337/203
2010/0197157 A1 * 8/2010 Wang ..... 439/275
2010/0259355 A1 * 10/2010 Buettner et al. ..... 337/187
2011/0117782 A1 * 5/2011 Su ..... 439/620.3
2011/0117783 A1 * 5/2011 Su ..... 439/620.26
2012/0056708 A1 * 3/2012 Ventura et al. ..... 337/207

* cited by examiner

*Primary Examiner* — Ross Gushi
(74) *Attorney, Agent, or Firm* — Armstrong Teasdale LLP

(57) ABSTRACT

A modular fuse holder includes a cover that is movable from a closed position to an open position relative to a base along two different paths of motion to prevent inadvertent opening or closing of the cover.

51 Claims, 3 Drawing Sheets

MODULAR OPEN FUSEHOLDER WITH MULTI-STAGE POSITIONABLE COVER

BACKGROUND OF THE INVENTION

The field of the invention relates generally to fuse holders or fuse blocks, and more specifically to modular fuse blocks adaptable for use with overcurrent protection fuses having opposed, axially extending terminal elements.

Electrical fuses are overcurrent protection devices for electrical circuitry, and are widely used to protect electrical power systems and prevent damage to circuitry and associated components when specified circuit conditions occur. A fusible element or assembly is coupled between terminal elements of the electrical fuse, and when specified current conditions occur, the fusible element or assembly melts or otherwise structurally fails and opens a current path between the fuse terminals. Line side circuitry may therefore be electrically isolated from load side circuitry through the fuse, preventing possible damage to load side circuitry from overcurrent conditions.

A considerable variety of overcurrent protection fuses are known and have been used to some extent with a corresponding variety of fuse holders. Improvements are, however, desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

FIGS. 1-4 illustrate various views of an exemplary modular fuse holder 100 including a nonconductive base 102 and a nonconductive cover 104 selectively positionable relative to the base 102 as explained below. The base 102 and the cover 104 collectively provide a degree of "finger safe" operation of the fuse holder 100. In an exemplary embodiment, the fuse holder provides an IP20 grade of protection per the applicable regulations of the International Electrotechnical Commission (IEC). As such, the fuse holder 100 is generally designed to protect a person from inadvertent finger contact with energized conductive portions of the fuse holder 100 in use. Any associated risk of electrical shock when servicing the fuse holder 100 is minimized, if not eliminated.

Figure 2:
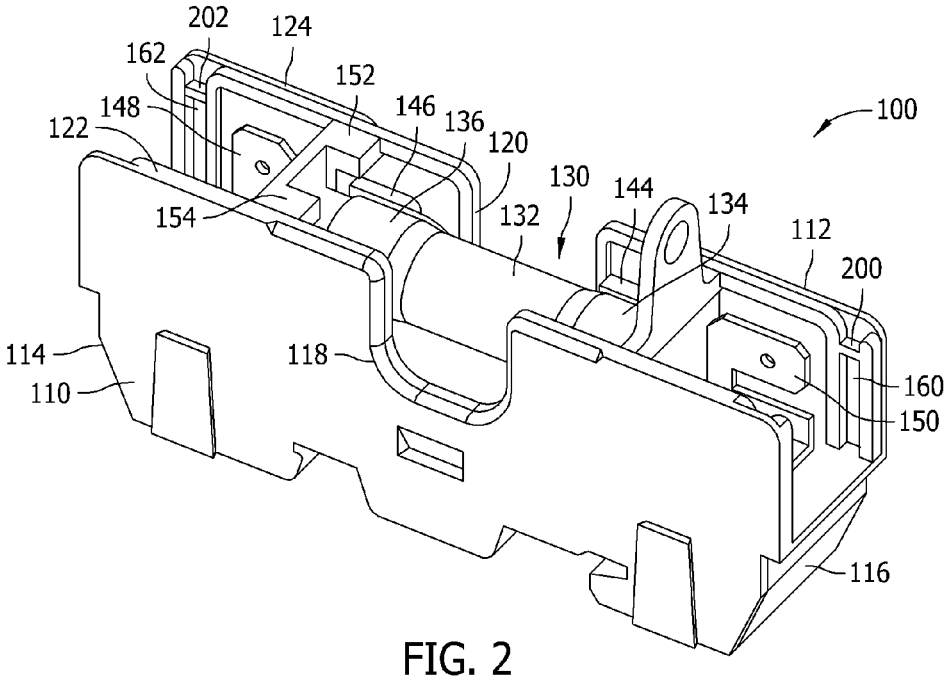
FIG. 2 is a top perspective view of the fuse holder shown in FIG. 1 with the cover removed.
Figure 3:
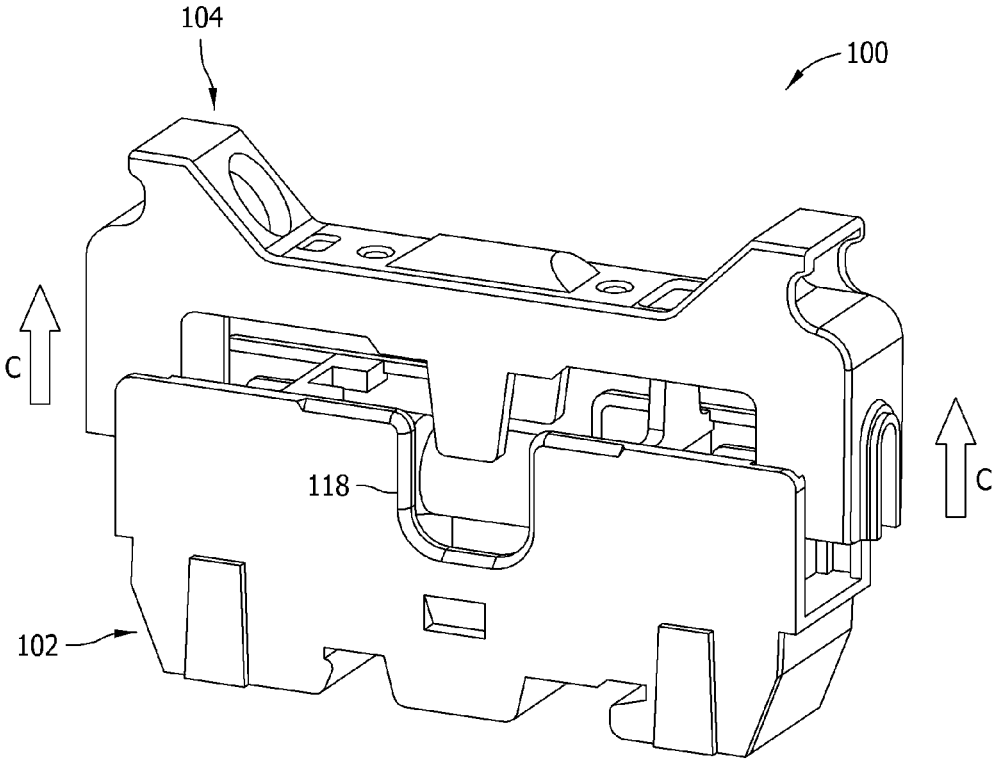
FIG. 3 is a view similar to FIG. 1 but illustrating a first stage of operation to open the cover.

The base 102 includes a bottom wall 106 that may be configured in the example shown with a DIN rail slot 108 for ease of mounting the fuse holder 100 in a known manner. Opposing lateral walls 110, 112 extending upwardly from the bottom wall 106, and opposed end walls 114, 116 interconnect the lateral side walls 110, 112 and the bottom wall 106. A portion of the end walls 114, 116 is angled or sloped in the embodiment shown, although this may be considered optional in some embodiments. The opposed lateral side walls 110, 112 each respectively include cutouts 118, 120 extending centrally between the end walls 114, 116 and being open along the upper periphery 122, 124 of the lateral side walls 118, 120 opposite the bottom wall 106. As best seen in FIG. 2, the openings 118, 120 provide access to a fuse 130 and more specifically the nonconductive body 132 of the fuse 132. As such, when the cover 104 is opened, as further described below, a person can grasp the body 132 of the fuse 130 and pull the fuse 130 upwardly to extract it from the fuse holder base 102.

The other side surfaces of the base lateral walls 110, 112 are configured with projections and grooves to allow adjacent bases 102 to be attached to one another, either directly or indirectly, with tongue and groove engagement to form a multiple pole fuse block assembly. The modular fuse holders 100 can therefore be arranged to accommodate any number of fuses in a relatively compact arrangement. Adjacent fuse holders 100 may be mechanically coupled or ganged together by hand and without use of tools in an interlocking manner.

Figure 5:
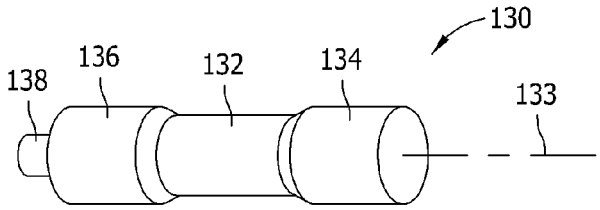
FIG. 5 illustrates an exemplary fuse for the fuse holder shown in FIGS. 1-4.

The exemplary fuse 130 for the exemplary fuse holder 100 is further shown in FIG. 5. The exemplary fuse 130 includes a generally elongated cylindrical fuse body 132 having a longitudinal axis 133. The fuse body 132 may be fabricated from a nonconductive material known in the art, and conductive terminal elements 134, 136 are attached to the opposing axial ends of the body 132 using, for example, known crimping techniques. The terminal elements 134, 136 may be provided in the form of conductive ferrules as shown. The ferrule 136 of the exemplary fuse 130 may further include a projection 138 as shown extending axially outwardly from the end of the ferrule 136 and having a relatively smaller diameter than the ferrule 136. Those in the art may accordingly recognize that the fuse 130 is a class CC fuse available from Cooper Bussmann of St. Louis, Mo., among others.

One or more fusible links or elements (not shown), or a fuse element assembly, is contained within the fuse body 132 and is connected between the fuse terminal elements 134, 136 so that when electrical current through the fuse 130 exceeds a predetermined limit, the fusible elements melt and open the circuit path through the fuse 130.

The base 102 as shown in FIG. 2, includes conductive fuse clips 144, 146 that are mounted to interior partition walls of the base 102 in a spaced apart relationship so that the respective fuse clips 144, 146 may resiliently receive and retain the ferrules 134, 136 when the fuse 130 is received in the base 102. Connection terminals 148, 150 are also coupled to the base 102, and in the exemplary embodiment shown the connection terminals 148, 150 are integrally formed with the fuse clips 134, 136. The connection terminals 148, 150 define termination structure to establish line side and load side electrical connections to electrical circuitry of an electrical power system.

As such, when the fuse 130 is installed in the fuse holder 100, the fusible element or elements that extend between the fuse terminals 134, 136 define a conductive current path for current to flow between the fuse clips 144, 146, and in turn completes a circuit path between the line and load side connection terminals 148, 150. When the fusible element or elements operate in response to specified current conditions, however, no current is conducted between the fuse terminal elements 134, 136 and the line side terminal 148 becomes electrically isolated from the load side terminal 150. The fuse 130 must then be replaced to restore operation of the circuitry.

It is important that the fuse 130 not be replaced with another and generally incompatible type of fuse. Because different types of fuses, however, can be relatively easily confused this presents practical concerns to power system administrators because installation of an incompatible fuse can either compromise the overcurrent protection of the electrical system or lead to sub-optimal operation of the power system. The consequences of having a mismatched fuse installed in the fuse holder 100 can be significant. Accordingly, the base 102 includes integrated rejection features in the form of projections 152, 154 to prevent this from happening.

The projections 152, 154 are dimensioned to project interior to the fuse receptacle proximate the fuse clip 146 in the example shown. Replacement fuses having the projection 138 (FIG. 4) on the ferrule 136 will clear these projections 152, 154 and may be fully engaged to the fuse clip 146. That is, the smaller diameter projection 138 will clear the restricted opening defined by the interior facing projections 152, 154. Replacement fuses that do not include the projection 138, however, will conflict with the restricted openings defined by the projections 152, 154. The larger diameter ferrule in an incompatible fuse will mechanically interfere with the projections, and any attempt to install the incompatible fuse will be frustrated.

The base rejecting projections 152, 154 may be fabricated integrally with the remainder of the base 102 using, for example, injection molding processes using heavy duty plastic materials. The base 102 may be fabricated as a single piece including all the features described above, or may alternatively be fabricated in two or more pieces that are assembled to one another. The fuse clips 144, 146 and connection terminals 148, 150 may be attached to the base 102 in any known manner, including but not limited to the use of mounting fasteners such as screws.

As shown in FIG. 2, the lateral side walls 110, 112 of the base 102 each include spaced apart guide rails or channels 160, 162 extending vertically in the view of FIG. 2 proximate the end walls 114, 116. The guide channels 160, 162 extend generally parallel to one another at the opposing end edges of the lateral side wall 112, which are open to provide access to the line and side connection terminals 148, 150. The side wall 110 likewise includes guide channels or rails that face the guide channels 160, 162 of the lateral side wall 112. The lateral side walls 110, 112 are substantially identically constructed, but arranged as mirror images to one another on opposing sides of the base 102. Thus, four guide channels are provided (two on each lateral walls 110, 112) in mutually opposed pairs proximate the end edges of the walls 110, 112. The guide surfaces in the example shown are linearly extending grooves formed in the interior surfaces of the lateral walls 110, 112, and hence may be fabricated in the mold used to form the remainder of the base 102. When the cover 104 is attached to the base 102, the cover 104 is guided in these channels in a two stage path of motion to open the cover 104 and expose the fuse clips 144, 146 and any fuse 130 that may be installed in the base 102.

The cover 104 in the example shown includes a top wall 170, lateral side walls 172, 174 and end walls 176, 178. The walls 170, 172, 174, 176, 178 generally complete the enclosure of the fuse 130 in the base 102. That is, the cover 170 closed the open top of the base 102 as shown in FIG. 2. The top wall 170 in the exemplary embodiment shown is contoured and includes a first handle portion 180 and a second handle portion 182 opposing one another near the end walls 176, 178. Each handle portion 180, 182 is elevated and defines a finger pull or finger tab for a person's use in manipulating the cover 104. The lateral side walls 172, 174 each include tabs 184, 186 (also shown in FIG. 4) that extend into and fill the openings 118, 120 in the base lateral walls 110, 112. The cover 104 may optionally include a lockout opening 188 through which a lockout extension 190 formed in the base 102 may extend. The extension 190 may be utilized with a shank lock, for example, to prevent the cover 104 from being opened or closed.

Figure 1:
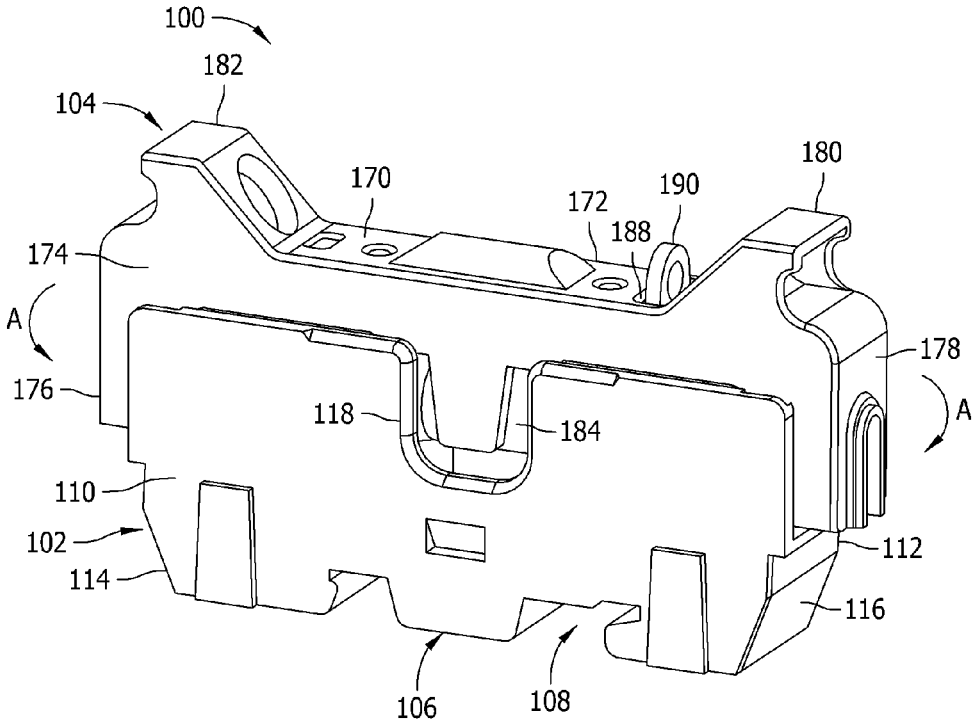
FIG. 1 is a side perspective view of an exemplary modular fuse holder.

The cover 104 may be fabricated into the exemplary shape shown, or alternative into other shapes as desired, via injection molding techniques and the like utilizing for example, non-conductive plastic materials known in the art. The cover 104 may further be fabricated from a transparent material so as to permit viewing of the fuse 130 even when the cover 104 is in a closed position relative to the base 102 as shown in FIG. 1. Alternatively, the cover 104 may be formed with apertures, openings or windows that various types of fuse state indicators may be easily viewed when the cover 104 is closed. A variety of different types of fuse state indicators exist, some of which are built into the fuse 130 and some of which are separately provided from the fuse 130. If separately provided, any such indicator may optionally be built into the cover 104 or otherwise assembled to it. Of course, depending on the type of indicator selected, certain features of the cover 104 may be rendered unnecessary.

The cover 104 includes guide projections 190, 192 (FIG. 4) extending on each lateral side wall 172, 174 adjacent the end walls 176, 178. The guide projections 190, 192 are formed as exterior facing round pegs that interface with the guide channels 160, 162 formed in the base 102. As such, four guide projections are provided (two on each lateral wall 176, 178 of the cover 104) in mutually opposed pairs proximate the end edges of the walls 176, 178. When the cover guide projections are engaged to the base guide channels, which may be accomplished with snap-fit engagement in the exemplary embodiment shown, all four corners of the cover 104 are mechanically attached and guided on the base 102. Advantageously, this allows the cover 104 to be rotatably opened on either end of the base 102 from the close position. Thus, considering FIG. 1, the cover 102 is rotatable in the direction of arrow A on a first end of the base 102, and also rotatable in the direction of arrow B, in a direction opposite to arrow A, on the opposed end of the base 102. In other words, the cover 104 may be opened from left to right with a first pivoting path of motion from the closed position shown in FIG. 1, or alternatively may be opened from left to right in a second pivoting path of motion from the closed position. The fuse holder 100, and specifically the base 102, need not be mounted in any particular orientation so that the cover 104 can be opened in an unobstructed manner, because the cover 104 may be opened from either direction. As a further illustrative example, if the base is mounted generally vertically on a support structure, the cover 104 can be opened from the top or the bottom edge of the base 102. This affords a flexibility of use that conventional fuse holders do not, for conventional fuse holders either fail to utilize a cover at all, utilize a completely removable cover that simply pulls off the fuse or base without any rotational path of motion, or utilize a one-way only path of motion (i.e., only a rotatable path) to open the cover.

Beneficially, the cover 104 interacting with the base 102 is openable using a two stage path of motion that precludes an inadvertent opening of the cover 104 that may occur using single stage opening covers. More specifically, when the cover guide projections are engaged with the base guide channels and the cover is fully closed as shown in FIG. 1, the cover projections are first moved linearly in the guide channels in the direction of Arrows C in FIG. 3. In the example shown, the path of motion in the direction of arrows C is generally perpendicular to the axis 133 (FIG. 5) of the fuse 130 when installed in the fuse clips 144, 146 (FIG. 2). The path of motion indicated by arrow C is therefore sometimes referred to as an extendable path because the cover 104 is moved directly away from the fuse clips 144, 146 in the base 102. If desired, however, alternative motion paths extending in other directions could be provided. That is, the linear path need not necessary extend perpendicularly to the axis 133 when the fuse 130 is installed. In any case, the linear path of motion in the first stage provides a clearance when the cover 104 is extended that allows the cover 104 to be rotated in the second stage without interfering with wires, cables and the like completing the electrical connections to the connection terminals 148, 150. However, when the cover 104 is retracted, the fuse holder 100 may nonetheless meet the requirements of IEC IP-20 and thus be a finger safe device.

Figure 4:
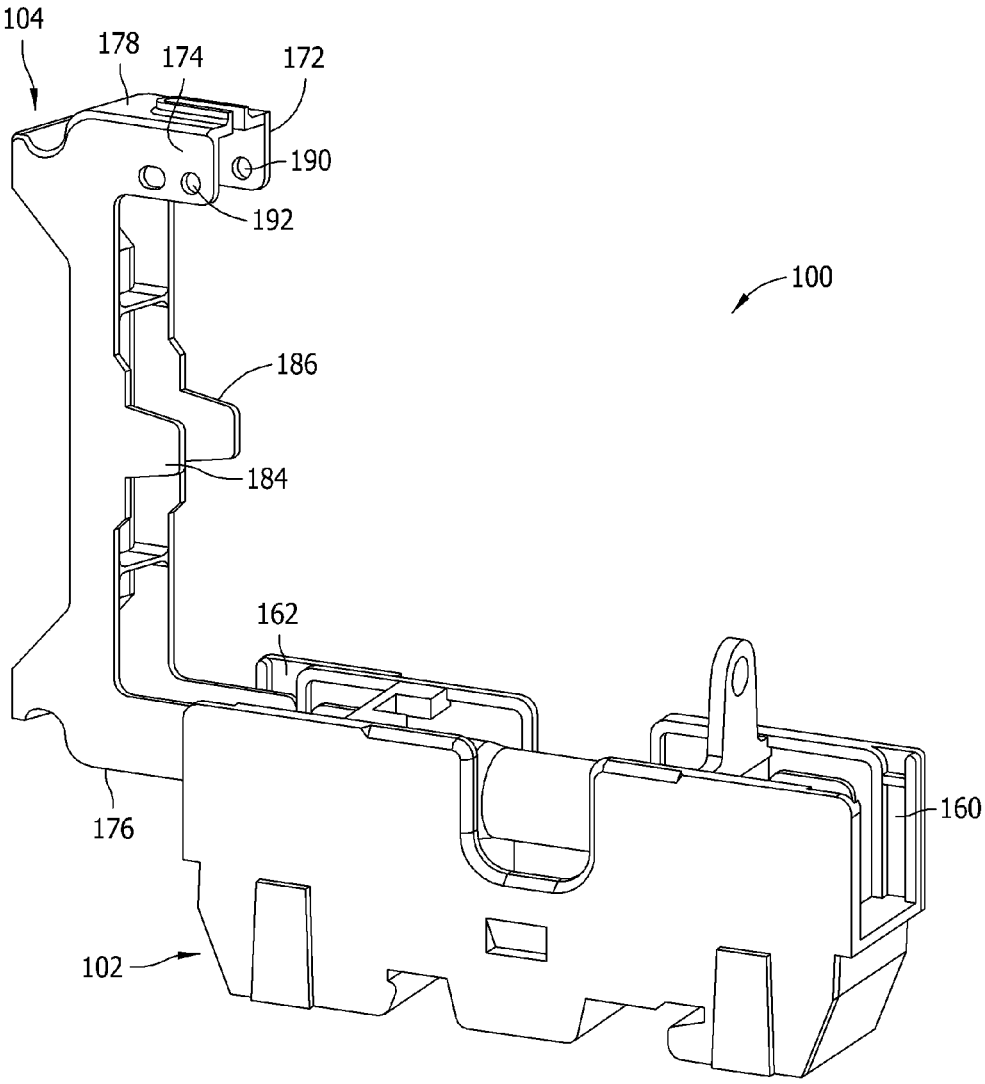
FIG. 4 illustrates a second stage of operation to open the cover.

The path of motion shown by Arrows C may continue until the cover guide projections reach built in stop surfaces 200, 202 (FIG. 2) formed in the base lateral walls 110, 112. At this point, one of the ends of the cover 104 may be mechanically released by disengaging the guide projections at that end from the guide channels. This may be accomplished by applying light pressure to the desired end to unsnap the cover guide projections from the base guide channels on one end of the cover 104, while leaving the other opposing end of the cover 104 engaged. Once one of the ends of the cover 104 is disengaged, the cover is rotatable in a second stage of operation about the end still engaged. The guide projections that remain engaged allow the cover to be pivoted as shown in FIG. 4 such that the fuse clips 144, 146 (FIG. 2) may be accessed to either remove the fuse 130 or install another fuse 130. While this is being done, the cover 104 may regain engaged to the base 104 at one end. This avoids any chance that the cover 104 may be completely removed from the base 104 and misplaced. The cover 104 may, however, easily be completely removed if desired by disengaging the remaining cover guide projections from the base guide channels.

To close the cover 104, an essentially opposite two stage path of motion is required. For example, the cover may be rotated from the open position shown in FIG. 4 back to the position shown in FIG. 3 wherein the disengaged cover guide projections are once again engaged to the cover guide channels in the base 102. From there, the cover 104 may be moved linearly in the direction opposite to the arrows C in FIG. 3 to fully close the cover 104. Stop surfaces may be built into the cover 104 and/or the base to fully secure the closed position. As mentioned, when fully closed, the cover 104 meets the requirements of IEC IP-20 and is a finger safe device.

The two stage operation of the cover 104 practically ensures that the cover 104 cannot be opened accidentally or inadvertently. From the fully closed position, any attempt to rotate the cover 104 is frustrated because all four corners of the cover 104 are engaged to the linear guide channels in the base 102. Only when the cover is moved fully in the linear direction of arrows C and the cover 104 easily be rotated, but only after first disengaging one of the ends of the cover 104. The cover 104 and the base 102 will positively prevent any effort to simply rotate the cover 104 to open it.

Further, because the cover 104 is engaged to the base 102 on all four corners thereof, the cover 104 may not easily be simply pulled off the base 102. The four stops (one at each corner at the top of the guide channels) will provide a sufficient resistance to prevent one from inadvertently pulling the cover 104 from the base 102. While it may be possible to remove the cover 104 from the base 102 simply by pulling it, it would require an amount of force well beyond what a person may inadvertently apply. As such, the two stage operation practically ensures that once the cover is closed it will remain closed, absent some intentional effort by a person to remove it.

Further, the cover 104 may not generally be installed to the base 102 using a simple, one stage method of attachment either. Rather, the cover 104 is first preferably engaged at one end by snapping the guide projections in the cover 104 to the guide channels in the base 102, then rotated to a position wherein the opposite end of the cover 104 can be engaged by snapping the guide projections in the cover 104. Then and only then can the cover 104 be retracted to the position shown in FIG. 1 from the extended position shown in FIG. 3. Just as the cover 104 and base 102 will frustrate its opening if the two stage operation is not followed, it will frustrate closing of the cover 104 as well.

It should not be apparent that numerous variations of the inventive concepts disclosed are possible to create equal or similar benefits. For example, while the illustrated embodiments include guide channels in the base 102 and guide projections formed into the cover 102, this arrangement could easily be reversed. That is, in another embodiment, guide channels may alternatively be formed in the cover 104 and guide projections may alternatively be formed in the base 102. Moreover, combinations of the guide channels and projections may be utilized on the base 102 or the cover 104, so long as the guide channels and projections mutually cooperated to provide the motion paths.

Furthermore, numerous variations in the two stage mode of operation can be envisioned. For example, the linear guide channels described can be curved if desired, such that the cover 104 will follow a curved path rather than a linear one prior to being released for the pivoting or rotating motion. As another example, two stages of linear motion along different paths may be configured with the guide surfaces providing a path to release the cover. Moreover, it may be possible to configure the guide channels such that the cover 104 must be rotated prior to reaching a path of linear motion leading to release of the cover. It is contemplated that more than two stages of operation along different motion paths may be integrated if desired.

As still another example, while in the illustrated embodiments the cover 104 includes exterior facing projections interfacing with interior facing guide channels in the base 102, the cover 104 may alternative be formed with interior facing projections interfacing with exterior facing guide channels in the base 102. Still other arrangements are possible.

The benefits and advantages of the invention are now believed to have been amply illustrated in connection with the exemplary embodiments disclosed.

An embodiment of a fuse holder has been disclosed including: a base having a bottom wall, end walls and lateral side walls defining an open top enclosure for accepting an overcurrent protection fuse; first and second fuse clips located on the base; and a cover extending over at least the first and second fuse clips and selectively positionable relative to the fuse clips in each of an extendable and rotatable position.

Optionally, at least one of the lateral side walls may include a first cover guide element and a second cover guide element formed therein, the first and second cover guide elements spaced apart from one another. The first and second cover guide elements may include one of a channel and a projection. The cover may include spaced apart lateral walls, and the spaced apart lateral walls may each include a first cover guide element and a second cover guide element formed therein, with the first and second cover guide elements being spaced apart from one another. The first and second cover guide elements may include one of a channel and a projection.

The base may define at least one pair of cover guide elements and the cover may define at least one pair of cover guide elements, with one of the pairs of cover guide elements comprising guide channels and the other of the pairs of cover guide elements comprising projections configured to engage the guide channels. The base may be provided with guide channels each located proximate one of the end walls. The cover may include opposed end walls and at least one guide cover projection located proximate each end wall. The guide channels each define a linear axis providing a linear path of movement of the projections therein. The linear path may extend for a length sufficient to provide a clearance for rotation of the cover about one end thereof. At least one of the projections may include a round peg providing a rotatable movement of the cover relative to one of the guide channels after the linear path of movement is completed.

The base and cover may be configured to provide slidable movement of the cover in a first direction and pivotal movement of the cover thereafter. The first direction may be a substantially linear direction, and the linear direction may extend generally perpendicular to a longitudinal axis of the overcurrent protection fuse when installed and engaged to the fuse clips. The cover may be rotatable about either end wall of the base.

An embodiment of a fuse holder has also been disclosed including: a base; first and second fuse clips located on the base; and a cover extending over at least the first and second fuse clips and selectively positionable relative to the fuse clips in an extended position relative to the base, a retracted position relative to the base, and a pivoted position relative to the base.

Optionally, one of the base and the cover may be provided with a guide channel, and the other of the base and the cover may be provided with a guide projection configured to engage the guide channel. The guide channel may define the extended position and the retracted position. The extended position may provide a clearance for pivoting of the cover about one end thereof. The guide channel may be formed with a stop, and the guide projection may be releasable from the guide channel to the pivoted position once the guide projection is located at the stop. The base may include opposed lateral walls, and each of the opposed lateral walls may include spaced apart guide channels. Each lateral wall may also be provided with spaced apart guide projections. The cover may be snap-fit to the base. The cover may be configured to pivot away from the fuse clips in a first direction and pivot away from the fuse clips in a second direction, the second direction opposite to the first direction.

An embodiment of a fuse holder has also been disclosed including: a base; first and second fuse clips located on the base; and a cover extending over at least the first and second fuse clips, the cover postionable relative to the base in a closed position and operable in first and second stages to an opened position providing access to the fuse clips.

Optionally, in one of the first stage and the second stage the cover may be movable in a linear direction away from the fuse clips. The linear direction may extend generally perpendicular to an axis of the fuse when installed in the fuse clips. In one of the first stage and the second stage the cover may be rotatable relative to the fuse clips. At least the first stage may be effected by a guide channel in one of the base and the cover. The cover may be releasable from the base at opposing ends thereof, and the second stage may be effected with only one of the ends coupled to the base. The cover may be snap-fit to the base. The first stage may create a clearance allowing the cover to rotate in the second stage.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuse holder comprising:

a base having a bottom wall, end walls and lateral side walls defining an open top enclosure for accepting an overcurrent protection fuse;

first and second fuse clips located on the base; and a cover extending over at least the first and second fuse clips and selectively positionable relative to the fuse clips in each of an extendable and rotatable position;

wherein the cover is rotatable about either end wall of the base.

2. The fuse holder of claim 1, wherein at least one of the lateral side walls includes a first cover guide element and a second cover guide element formed therein, the first and second cover guide elements spaced apart from one another.

3. The fuse holder of claim 2, wherein the first and second cover guide elements comprise one of a channel and a projection.

4. The fuse holder of claim 1, wherein the cover includes spaced apart lateral walls, and the spaced apart lateral walls each include a first cover guide element and a second cover guide element formed therein, the first and second cover guide elements spaced apart from one another.

5. The fuse holder of claim 4, wherein the first and second cover guide elements comprises one of a channel and a projection.

6. The fuse holder of claim 1, wherein the base defines at least one pair of cover guide elements and wherein the cover defines at least one pair of cover guide elements, one of the pairs of cover guide elements comprising guide channels and the other of the pairs of cover guide elements comprising projections configured to engage the guide channels.

7. The fuse holder of claim 6, wherein the base is provided with guide channels each located proximate one of the end walls.

8. The fuse holder of claim 6, wherein the cover comprises opposed end walls and at least one guide cover projection located proximate each end wall.

9. The fuse holder of claim 6, wherein the guide channels each define a linear axis providing a linear path of movement of the projections therein.

10. The fuse holder of claim 9, wherein at least one of the projections comprises a round peg providing a rotatable movement of the cover relative to one of the guide channels after the linear path of movement is completed.

11. The fuse holder of claim 9, wherein the linear path extends for a length sufficient to provide a clearance for rotation of the cover about one end thereof.

12. The fuse holder of claim 1, wherein the base and cover are configured to provide slidable movement of the cover in a first direction and pivotal movement of the cover thereafter.

13. The fuse holder of claim 12, wherein the first direction is a substantially linear direction.

14. The fuse holder of claim 1, wherein the base and cover are configured to provide slidable movement of the cover in a first direction and pivotal movement of the cover thereafter.

15. The fuse holder of claim 14, wherein the first direction is a substantially linear direction.

16. The fuse holder of claim 15, wherein the substantially linear direction extends generally perpendicular to a longitudinal axis of the overcurrent protection fuse when installed and engaged to the fuse clips.

17. The fuse holder of claim 1, wherein the base further comprises a lockout extension.

18. The fuse holder of claim 1, wherein the cover defines a lockout opening.

19. A fuse holder comprising:

a base having a bottom wall, end walls and lateral side walls defining an open top enclosure for accepting an overcurrent protection fuse;

first and second fuse clips located on the base; and a cover extending over at least the first and second fuse clips and selectively positionable relative to the fuse clips in each of an extendable and rotatable position;

wherein the base and cover are configured to provide slidable movement of the cover in a first direction and pivotal movement of the cover thereafter;

wherein the first direction is a substantially linear direction; and wherein the substantially linear direction extends generally perpendicular to a longitudinal axis of the overcurrent protection fuse when installed and engaged to the fuse clips.

20. The fuse holder of claim 19, wherein at least one of the lateral side walls includes a first cover guide element and a second cover guide element formed therein, the first and second cover guide elements spaced apart from one another.

21. The fuse holder of claim 20, wherein the first and second cover guide elements comprise one of a channel and a projection.

22. The fuse holder of claim 19, wherein the cover includes spaced apart lateral walls, and the spaced apart lateral walls each include a first cover guide element and a second cover guide element formed therein, the first and second cover guide elements spaced apart from one another.

23. The fuse holder of claim 22, wherein the first and second cover guide elements comprises one of a channel and a projection.

24. The fuse holder of claim 19, wherein the base defines at least one pair of cover guide elements and wherein the cover defines at least one pair of cover guide elements, one of the pairs of cover guide elements comprising guide channels and the other of the pairs of cover guide elements comprising projections configured to engage the guide channels.

25. The fuse holder of claim 24, wherein the base is provided with guide channels each located proximate one of the end walls.

26. The fuse holder of claim 24, wherein the cover comprises opposed end walls and at least one guide cover projection located proximate each end wall.

27. The fuse holder of claim 24, wherein the guide channels each define a linear axis providing a linear path of movement of the projections therein.

28. The fuse holder of claim 27, wherein at least one of the projections comprises a round peg providing a rotatable movement of the cover relative to one of the guide channels after the linear path of movement is completed.

29. The fuse holder of claim 19, wherein the cover is rotatable about either end wall of the base.

30. The fuse holder of claim 19, wherein the cover is configured to pivot away from the fuse clips in a first direction and pivot away from the fuse clips in a second direction, the second direction opposite to the first direction.

31. The fuse holder of claim 19, wherein the base further comprises a lockout extension.

32. The fuse holder of claim 19, wherein the cover defines a lockout opening.

33. A fuse holder comprising:

a base;

first and second fuse clips located on the base; and a cover extending over at least the first and second fuse clips and selectively positionable relative to the fuse clips in an extended position relative to the base, a retracted position relative to the base, and a pivoted position relative to the base;

wherein the cover is configured to pivot away from the fuse clips in a first direction and pivot away from the fuse clips in a second direction, the second direction opposite to the first direction.

34. The fuse holder of claim 33 wherein one of the base and the cover are provided with a guide channel, and the other of the base and the cover is provided with a guide projection configured to engage the guide channel.

35. The fuse holder of claim 34, wherein the guide channel defines the extended position and the retracted position.

36. The fuse holder of claim 35, wherein the extended position provides a clearance for pivoting of the cover about one end thereof.

37. The fuse holder of claim 33, wherein the guide channel is formed with a stop, and the guide projection is releasable from the guide channel to the pivoted position once the guide projection is located at the stop.

38. The fuse holder of claim 33, wherein the base includes opposed lateral walls, and each of the opposed lateral walls include spaced apart guide channels.

39. The fuse holder of claim 38, wherein the cover includes opposed lateral walls, and each lateral wall provided with spaced apart guide projections.

40. The fuse holder of claim 33, wherein the cover is snap-fit to the base.

41. The fuse holder of claim 33, wherein the base further comprises a lockout extension.

42. The fuse holder of claim 33, wherein the cover defines a lockout opening.

43. A fuse holder comprising:

a base;

first and second fuse clips located on the base; and a cover extending over at least the first and second fuse clips, the cover postionable relative to the base in a closed position and operable in first and second stages to an opened position providing access to the fuse clips;

wherein the cover is releasable from the base at opposing ends thereof, and the second stage is effected with only one of the ends coupled to the base.

44. The fuse holder of claim 43, wherein in one of the first stage and the second stage the cover is movable in a linear direction away from the fuse clips.

45. The fuse holder of claim 44, wherein the linear direction extends generally perpendicular to an axis of the fuse when installed in the fuse clips.

46. The fuse holder of claim 43 wherein in one of the first stage and the second stage the cover is rotatable relative to the fuse clips.

47. The fuse holder of claim 43, wherein at least the first stage is effected by a guide channel in one of the base and the cover.

48. The fuse holder cover of claim 43, wherein the cover is snap-fit to the base.

49. The fuse holder of claim 43, wherein the first stage creates a clearance allowing the cover to rotate in the second stage.

50. The fuse holder of claim 43, wherein the base further comprises a lockout extension.

51. The fuse holder of claim 44, wherein the cover defines a lockout opening.

* * * * *